US006481189B2

(12) United States Patent
Bates

(10) Patent No.: US 6,481,189 B2
(45) Date of Patent: Nov. 19, 2002

(54) SADDLES

(75) Inventor: Ronald Gordon Bates, Mt. Lawley (AU)

(73) Assignee: Hammersmith Nominees PTY, Ltd., Perth (AU)

( * ) Notice: Subject to any disclaimer, the term of this patent is extended or adjusted under 35 U.S.C. 154(b) by 0 days.

(21) Appl. No.: 09/809,824

(22) Filed: Mar. 15, 2001

(65) Prior Publication Data

US 2001/0029726 A1 Oct. 18, 2001

(30) Foreign Application Priority Data

Mar. 23, 2000 (AU) ..... PQ6416

(51) Int. Cl.[7] ..... B68C 1/08
(52) U.S. Cl. ..... 54/44.6; 54/44.1
(58) Field of Search ..... 54/44, 44.1, 44.6, 54/66

(56) References Cited

U.S. PATENT DOCUMENTS

| | | | | | |
|---|---|---|---|---|---|
| 3,343,338 | A | * | 9/1967 | Stuebben | 54/44 |
| 4,033,097 | A | * | 7/1977 | Petit | 54/44 |
| 4,683,709 | A | * | 8/1987 | Vasko et al. | 54/66 |
| 5,027,589 | A | * | 7/1991 | Gleb et al. | 54/66 |
| 5,787,692 | A | * | 8/1998 | Purdy | 54/66 |
| 5,802,823 | A | * | 9/1998 | Woods | 54/66 |
| 6,050,067 | A | * | 4/2000 | Knight et al. | 54/44.6 |

* cited by examiner

*Primary Examiner*—Charles T. Jordan
*Assistant Examiner*—Bret Hayes
(74) *Attorney, Agent, or Firm*—Knobbe, Martens, Olson & Bear LLP

(57) ABSTRACT

A saddle for equestrian use has panels having sealed air bags filled with air at atmospheric pressure to permit an even pressure to be applied over the back of a horse. The interior of the panel above the air bags is filled with packing material to permit adjustment of the fit of the saddle on the horse throughout the working life of the saddle.

13 Claims, 4 Drawing Sheets

SADDLES

BACKGROUND OF THE INVENTION

1. Field of the Invention

The present invention relates to saddles for equestrian use.

2. Description of the Prior Art

A conventional saddle has at its underside panels of a compressible structure intended to spread the weight of the rider over the back of the horse. Conventionally, the panels consist of an envelope into which a packing of wool or comparable synthetic material is inserted by hand. In principle, the packing formed by the wool or other filling is intended to conform to the shape of the horse's back and thereby to spread the load while minimising pressure points on the horse's back. When a saddle is used only on one horse, the panels of the saddle will, over a period of time, compress and set to take on the shape of the particular horse's back. However the extent of possible compression which occurs in the packing is relatively limited and unless the saddle tree is shaped to the exact conformity of the horse, pressure points often arise where too much of the weight of the rider is transferred to the horse's back in specific areas. This results in the skin not receiving sufficient blood flow which reduces the ability of the skin to sweat and if this situation continues for a long period of time it can result in hair loss, sore back, and possible muscle damage to the horse. These problems are compounded when, and as often happens, the saddle is used on more than one horse and whereby the compression needed to properly bed the saddle down onto the horse will not arise.

SUMMARY OF THE INVENTION

According to the present invention, there is provided a saddle for equestrian use, the saddle having panels, each panel containing a plurality of sealed air bags and, externally of the air bags in relation to the horse, a packing capable of adjustment, a separate said air bag being at least in a forward part and a rearward part of the panel and each bag in use serving to apply a relatively even pressure to the back of the horse.

Advantageously each air bag is substantially flat and is substantially filled within its interior with a resiliently compressible open cell foam.

In a preferred embodiment of the invention, the bags within each panel are formed into a single unit for insertion into the panel.

Advantageously, the external surface of each bag or of the bag unit carries a lining to prevent damage to the bags during insertion of, or re-packing of, the packing.

Further according to the invention, there is provided a saddle for equestrian use, the saddle having panels, the improvement comprising inserting into each of the panels a plurality of sealed air bags, said bags lying adjacent a part of the panel which contacts the back of the horse whereby the bags provide a padding effect to distribute to the back of the horse the loading arising in use of the saddle, providing a lining layer to shield the air bags, inserting into the panels packing material, said packing material contacting the lining layer, and adjusting the packing material within the panel.

BRIEF DESCRIPTION OF THE DRAWINGS

An embodiment of the invention will now be described, by way of example only, with reference to the accompanying drawings in which.

DESCRIPTION OF THE PREFERRED EMBODIMENTS

As shown in the accompanying drawings a saddle in accordance with the preferred embodiment of the invention is, save for the filling within the panels, of known construction using leather, synthetic materials or a combination of leather and synthetic materials. In accordance with the invention, each of the panels 2 defines an envelope which receives an arrangement of air bags 4 and, above the air bags 4 either along the entire length of the panel 2 or at selected positions, packing 6 preferably in the form of a wool stuffing. The air bags 4 are arranged sequentially in a fore-aft direction within the panel 2. There may be just two such air bags forming front and rear air bags collectively extending the length of the panel 2 or there may be three or possibly more such air bags consisting of a front, a rear, and one or more intermediate air bags collectively extending the length of the panel 2. The respective air bags 4 are sealed and as a result air will not flow between the bags. It is to be noted that if only a single air bag were to be used extending the length of the panel substantial air movement would occur from the front to the back of the panel when the air bag is under pressure during use and this could result in the formation of pressure points. Although with the arrangement now proposed air movement will occur within each individual bag when under load, the extent of air movement is inherently restricted by the length of the bag.

Figure 1:
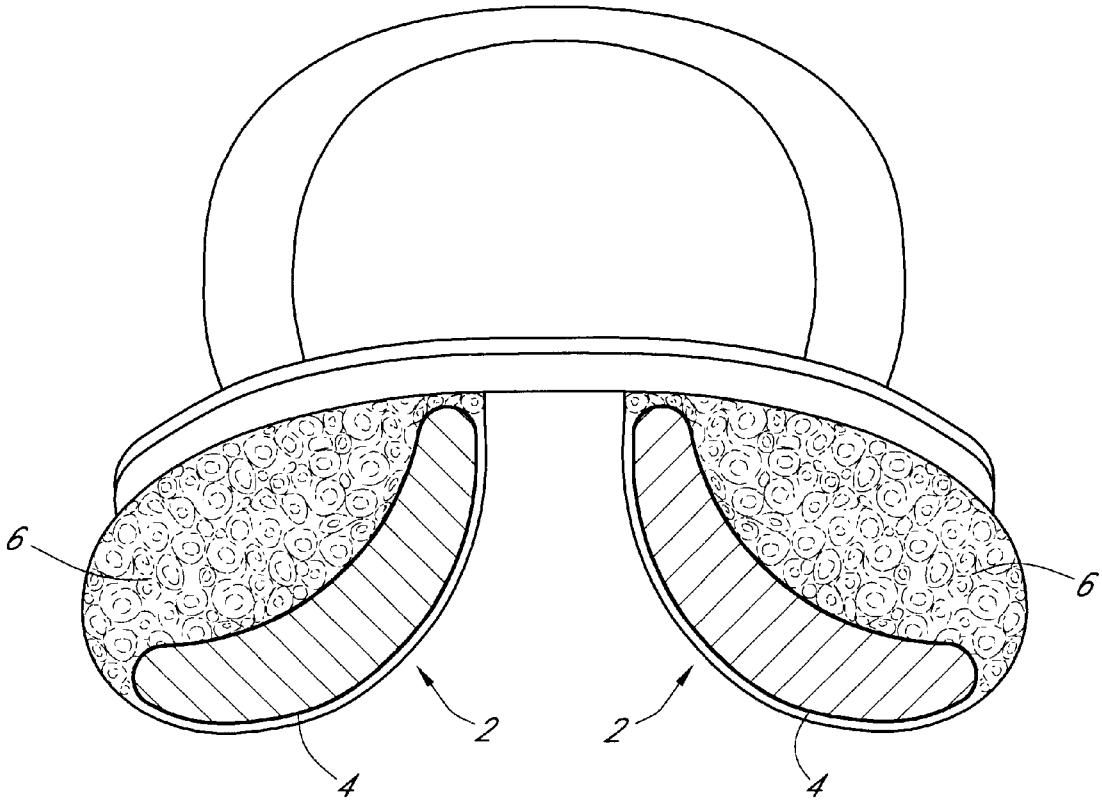
FIG. 1 is a schematic cross-section of a saddle in accordance with a preferred embodiment of the invention showing the saddle panels containing an air bag arrangement and adjustable packing externally of the air bags.
Figure 2:
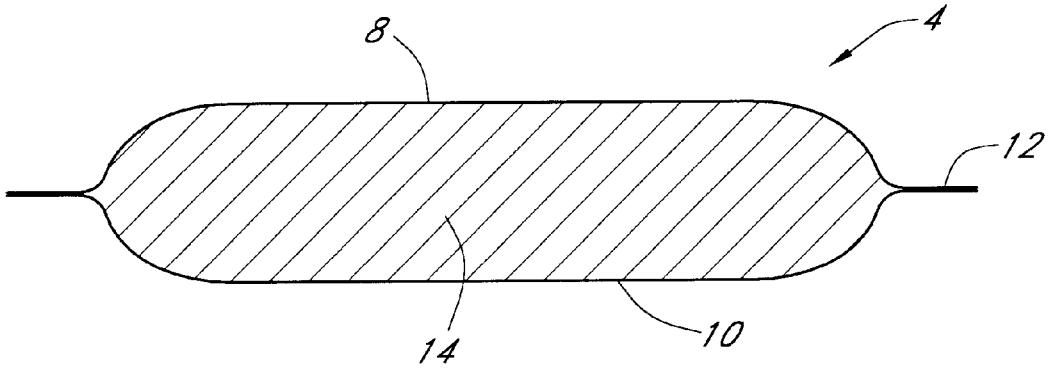
FIG. 2 is a cross-section through an individual air bag.
Figure 3:
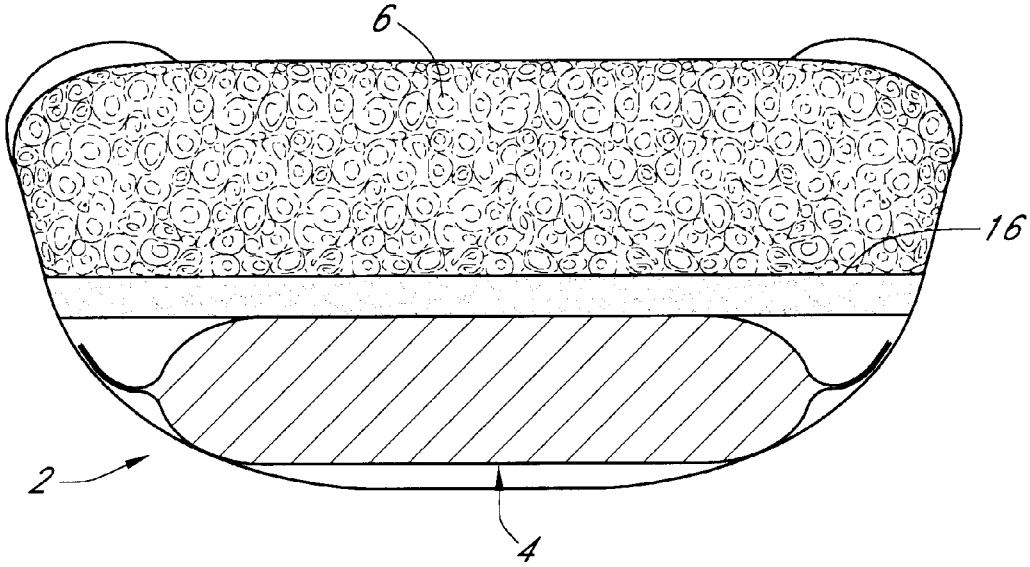
FIG. 3 is a section showing schematically the configuration of the air bag, an associated liner, and packing within the panel.

With reference to FIG. 2, each air bag 4 is formed by upper and lower sheets 8, 10 of impervious material such as PVC sealed together around the periphery 12 with each bag having a filling 14 consisting of a layer of an open cell resiliently compressible foam. The air bags 4 are not inflated with air at above atmospheric pressure but, rather, contain air at atmospheric pressure which is sealed within the bag during manufacture, with the open cell foam filling 14 occupying substantially the entirety of the interior of the bag. The resulting air bag is substantially flat and of substantially even thickness throughout.

Figure 4:
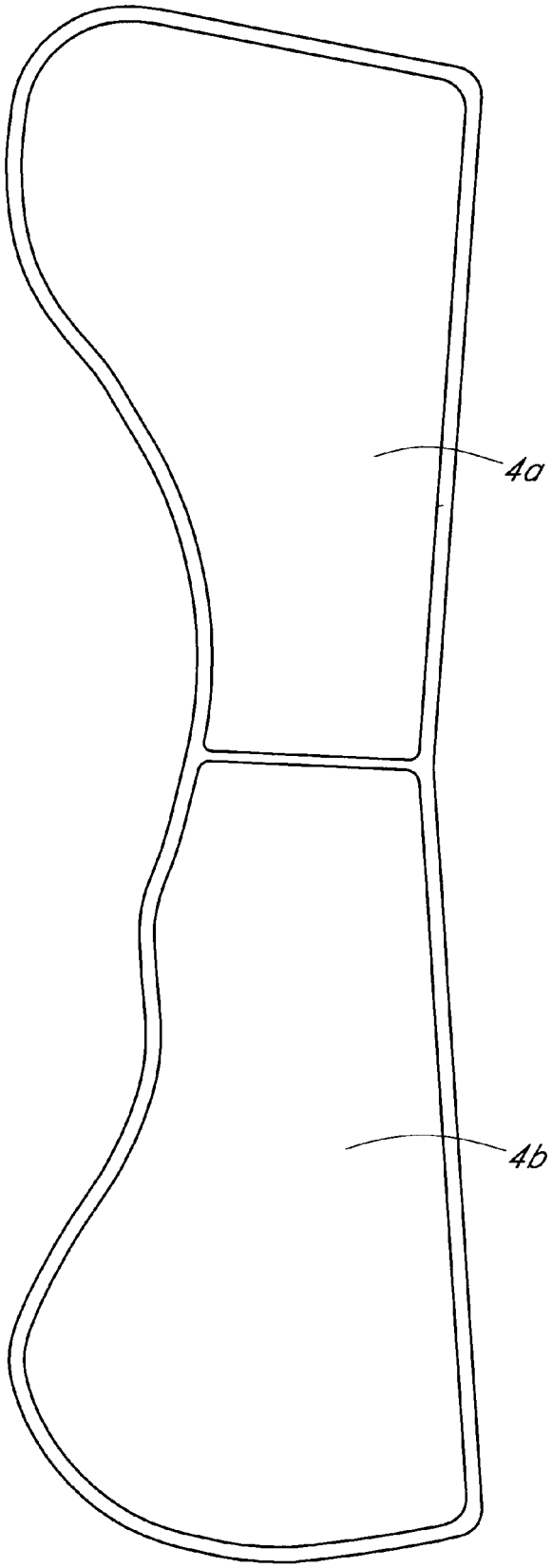
FIG. 4 is an underneath plan view showing an air bag unit consisting of front, and rear air bags.
Figure 5:
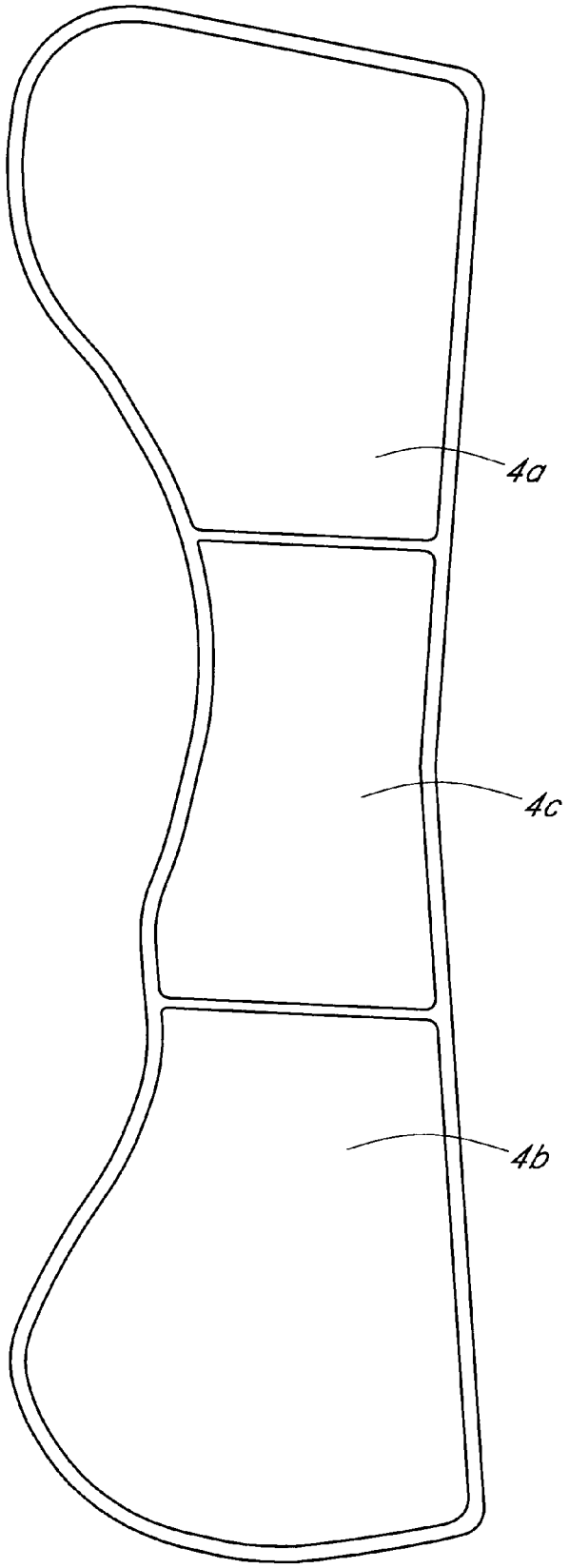
FIG. 5 is an underneath plan view of an air bag unit consisting of front, intermediate, and rear air bags.

The two or more air bags 4 are fitted into the panel 2 and then the wool or other appropriate packing 6 is placed above the air bags where required. Advantageously, the two or more bags 4 are formed into an air bag unit by attaching a layer 16 of flexible lining material to the upper surface of the air bags 4, for example by glueing. The lining 16 will prevent the air bags 4 from being punctured while the wool or other packing 6 is being inserted and also serves to consolidate the two or more bags 4 into a single unit to facilitate assembly. The lining 16 may consist of a felt or a suitable plastics material such as PVC. FIG. 4 shows an air bag unit consisting of front and rear air bags 4*a*, 4*b* and FIG. 5 shows an air bag unit consisting of front, intermediate, and rear air bags 4*a*, 4*c*, 4*b*. the packing 6 will normally be added in the part of the panel 2 which guides the knee of the rider, and at the rear of the panel 2 where extra depth is required. Very little packing is likely to be required in the middle part of the panel 2 although it can be added if required.

The effect of the air bag arrangement is that, in use, air will move within each separate bag and an even pressure will be applied over the entire surface of each air bag at the front or back of the saddle thereby eliminating individual pressure points on the back of the horse, in contrast to conventional saddles where significant pressure variation on the horse's back can arise within a relatively small area. The application of the even pressure over the surface of the bag is expected to substantially remove possibility for muscle damage and it is expected that this will result in a much freer and more comfortable movement of the horse in use.

A significant advantage of using the air bag arrangement in combination with appropriate packing is that it is possible for saddlers to re-adjust the fit of the saddle to optimise the effects of the air bag arrangement at any time throughout its life thereby providing substantial flexibility in use. The re-adjustment, which is accomplished by adjusting the position of the packing or by re-packing, is a straightforward task for a saddler and the presence of the lining above the air bags will ensure the integrity of the air bags during this process.

It will be understood that although a number of different plastics materials will have substantial impermeability to passage of air and will form suitable materials for the air bags, absolute impermeability might not always be achieved with the result that minor amounts of air might displace through the bag wall when the bag is under heavy loading during prolonged use resulting in minor deflation which does not, however, adversely affect the performance of the bag, but under normal usage this should not occur. However should minor deflation occur under the circumstances discussed above, when the saddle is removed from the horse and the air bag is no longer under load, it has been determined that the expansion of the open cell foam filling within the bag from its previously compressed state does, over a period of time (such as several weeks), cause air to be drawn back into the interior of the bag to establish pressure equilibrium across the wall of the bag. However it is envisaged that if air loss through the bag wall during use does present a problem, laminates can be used which will totally eliminate air loss although these laminates can be relatively expensive and will therefore lead to increased costs.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

The embodiment has been described by way of example only and modifications are possible within the scope of the invention.

What is claimed is:

1. A saddle for equestrian use, the saddle having panels, each panel containing a plurality of sealed air bags and, externally of the air bags in relation to a horse, a packing capable of adjustment, a separate air bag being at least in a forward part and a rearward part of the panel and each bag in use serving to apply a relatively even pressure to the back of the horse, each air bag being substantially flat and being substantially filled within its interior with a resiliently compressible open cell foam, and the bags within each panel being formed into a single unit for insertion into the panel, wherein said unit comprises separate air bags attached to a layer of flexible lining material, said layer of flexible lining material lying between the bags and the packing and serving also to inhibit puncturing of the bags during insertion of the packing into the panel.

2. A saddle according to claim 1, wherein each said bag comprises opposed layers of sheet material sealed together at adjacent edges such that air at atmospheric pressure is enclosed within the bag.

3. A saddle for equestrian use, the saddle having panels, each panel containing a plurality of sealed air bags and externally of the air bags in relation to a horse, a backing capable of adjustment, a separate said air bag being at least in a forward part and a rearward part of the panel and each bag in use serving to apply a relatively even pressure to the back of the horse, each air bag being substantially flat and being substantially filled within its interior with a resiliently compressible open cell foam, and each said bag comprising opposed layers of sheet material sealed together at adjacent edges such that air at atmospheric pressure is enclosed within the bag, wherein the bags are constructed of sheet material which is substantially impervious to a passage of air therethrough but which is, under exposure to prolonged loading during use of the saddle, susceptible to minor leakage of air through the bag resulting in deflation of the bag from a non-loaded configuration, the arrangement being such that upon removal of the loading, consequent expansion of the bag to its non-loaded configuration by re-expansion of the foam filling will cause atmospheric air to be drawn back into the interior of the bag over a substantial period of time.

4. A saddle according to claim 1, wherein each bag is filled with air at atmospheric pressure.

5. A saddle according to claim 1, wherein said air bags are positioned in said panel to provide a forward, intermediate, and rear air bag in end-to-end relation.

6. A saddle according to claim 1, wherein the air bags are arranged in the panel to provide a forward and rear air bag in end-to-end relation.

7. A saddle for equestrian use, the saddle having panels, and a plurality of air bags inserted into the panels and lying adjacent a part of each panel which contacts the back of a horse whereby the bags provide a padding effect to distribute to the back of the horse loading arising in use of the panel, each air bag being of a material which is substantially impervious to passage of air therethrough, each air bag being substantially flat and being substantially flat and being filled with a predetermined volume of air at substantially atmospheric pressure at the time of manufacture without provision for inflation to a higher pressure, and each air bag being substantially filled within its interior with a resiliently compressible open cell foam, whereby the padding effect of the air bag in use of the saddle is provided by the combination effects of the air sealed within the bag and the foam filling.

8. The saddle of claim 7, wherein each panel contains packing at the side of the air bags remote from the horse.

9. The saddle of claim 8 comprising a flexible lining layer between the bags and the packing, the lining layer serving to inhibit puncturing of the air bags during insertion of the packing into the panel.

10. The saddle of claim 7, wherein the bags within each panel are formed into a single unit for insertion into the panel.

11. The saddle of claim 9, wherein the bags within each panel are formed into a single unit for insertion into the panel by attachment to the lining layer.

12. The saddle of claim 7, wherein, in the event of minor leakage of air from the air bags as a result of prolonged loading during use of the saddle, the foam filling is able to re-expand after removal of the loading to re-expand the bags to their original configuration with air at atmospheric pressure being drawn back into the interior over a prolonged period of time.

13. A saddle for equestrian use, the saddle having panels, and a plurality of air bags inserted to the panels and lying adjacent a part of each panel which contacts the back of a horse whereby the bags provide a padding effect to distribute to the back to the horse loading arising in use of the panel, each air bag being of a material which is substantially impervious to passage of air therethrough, each air bag being substantially flat and being filled with a predetermined volume of air at atmospheric pressure at the time of manufacture without the need for inflation to a higher pressure for usage of the air bags, and each air bag being substantially filled within its interior with a resiliently compressible open cell foam, whereby the padding effect of the air bag in use of the saddle is provided by the combined effects of the air sealed within the bag and the foam filling.

* * * * *

US006481189C1

(12) EX PARTE REEXAMINATION CERTIFICATE (5695th)

United States Patent

Bates

(10) Number: US 6,481,189 C1

(45) Certificate Issued: *Mar. 6, 2007

(54) SADDLES

(75) Inventor: Ronald Gordon Bates, Mt. Lawley (AU)

(73) Assignee: Hammersmith Nominees Pty Ltd, Perth (AU)

Reexamination Request:
No. 90/007,508, Apr. 13, 2005

Reexamination Certificate for:

| | |
|---|---|
| Patent No.: | **6,481,189** |
| Issued: | **Nov. 19, 2002** |
| Appl. No.: | **09/809,824** |
| Filed: | **Mar. 15, 2001** |

( * ) Notice: This patent is subject to a terminal disclaimer.

(30) Foreign Application Priority Data

Mar. 23, 2000 (AU) ..... PQ6416

(51) Int. Cl.
*B68C 1/08* (2006.01)
*B68C 1/02* (2006.01)

(52) U.S. Cl. ..... 54/44.6; 54/44.1

(58) Field of Classification Search ..... None
See application file for complete search history.

(56) References Cited

U.S. PATENT DOCUMENTS

| | | | |
|---|---|---|---|
| 734,100 | A | 7/1903 | Sena |
| 4,471,538 | A | 9/1984 | Pomeranz et al. |
| 4,695,496 | A | 9/1987 | Lee |
| 4,745,734 | A | 5/1988 | Brown |
| 4,840,425 | A | 6/1989 | Noble |
| 4,974,397 | A | 12/1990 | Ricken |
| 5,018,341 | A | 5/1991 | Evertson |
| 5,179,821 | A | 1/1993 | Hiser |
| 5,299,412 | A | 4/1994 | Cudney et al. |
| 5,329,751 | A | 7/1994 | Wadsworth |
| 5,363,631 | A | 11/1994 | Garrison |
| 5,383,328 | A | 1/1995 | Brown |
| 5,517,808 | A | 5/1996 | Schleese |
| 5,555,710 | A | 9/1996 | Smith |
| 5,685,133 | A | 11/1997 | Travis |
| 5,782,070 | A | 7/1998 | Knight et al. |

FOREIGN PATENT DOCUMENTS

| | | |
|---|---|---|
| AU | 23770/92 | 11/1993 |
| CH | 446 045 | 3/1968 |
| DE | 2 133 034 | 1/1973 |
| DE | 2 259 376 | 6/1974 |
| DE | 24 28 852 | 1/1976 |
| DE | 40 36 907 | 5/1992 |
| DE | 41 00 027 | 7/1992 |
| DE | 41 14 433 | 11/1992 |
| DE | 94 11 519.2 | 11/1994 |
| DE | 199 47 304 | 4/2001 |
| EP | 0 060 449 | 9/1985 |
| EP | 0 328 376 | 10/1991 |
| EP | 0 764 607 | 5/2000 |
| FR | 2 632 623 | 12/1989 |
| FR | 2 667 584 | 4/1992 |
| FR | 2670769 | 6/1992 |
| GB | 434459 | 9/1935 |
| GB | 1 453 810 | 10/1976 |
| GB | 2 090 512 | 7/1982 |
| GB | 2 108 362 | 5/1983 |
| GB | 2 259 436 | 3/1993 |
| GB | 2 279 546 | 1/1995 |
| GB | 2 282 742 | 4/1995 |
| GB | 2 304 521 | 3/1997 |
| GB | 2 308 799 | 7/1997 |
| GB | 2 336 092 | 10/1999 |
| WO | WO 90/00518 | 1/1990 |
| WO | WO 93/23330 | 11/1993 |
| WO | WO 94/18115 | 8/1994 |
| WO | WO 98/29331 | 7/1998 |
| WO | WO 99/18028 | 4/1999 |

*Primary Examiner*—Beverly M. Flanagan

(57) ABSTRACT

A saddle for equestrian use has panels having sealed air bags filled with air at atmospheric pressure to permit an even pressure to be applied over the back of a horse. The interior of the panel above the air bags is filled with packing material to permit adjustment of the fit of the saddle on the horse throughout the working life of the saddle.

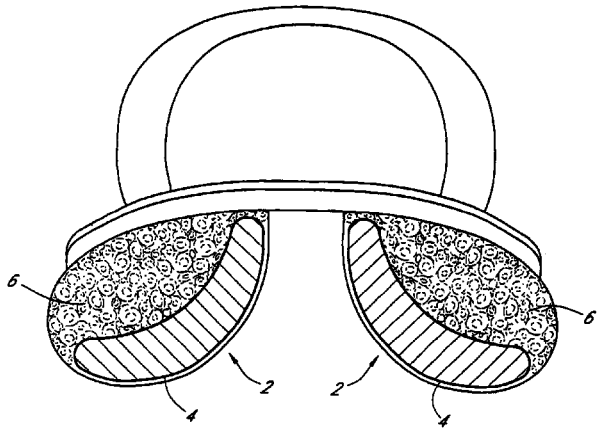

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1, 2, and 4–6 is confirmed.

Claims 8 and 13 are cancelled.

Claims 3, 7 and 9 are determined to be patentable as amended.

Claims 10–12, dependent on an amended claim, are determined to be patentable.

3. A saddle for equestrian use, the saddle having panels, each panel containing a plurality of sealed air bags and externally of the air bags in relation to a horse, a [backing] *packing* capable of adjustment, a separate said air bag being at least in a forward part and a rearward part of the panel and each bag in use serving to apply a relatively even pressure to the back of the horse, each air bag being substantially flat and being substantially filled within its interior with a resiliently compressible open cell foam, and each said bag comprising opposed layers of sheet material sealed together at adjacent edges such that air at atmospheric pressure is enclosed within the bag, wherein the bags are constructed of sheet material which is substantially impervious to a passage of air therethrough but which is, under exposure to prolonged loading during use of the saddle, susceptible to minor leakage of air through the bag resulting in deflation of the bag from a non-loaded configuration, the arrangement being such that upon removal of the loading, consequent expansion of the bag to its non-loaded configuration by re-expansion of the foam filling will cause atmospheric air to be drawn back into the interior of the bag over a substantial period of time.

7. A saddle for equestrian use, the saddle having panels, and a plurality of air bags inserted into the panels and lying adjacent a part of each panel which contacts the back of a horse *and wherein each panel contains packing at the side of the air bags remote from the horse* whereby the bags provide a padding effect to distribute to the back of the horse loading arising in use of the panel, each air bag being of a material which is substantially impervious to passage of air therethrough, each air bag being substantially flat [and being substantially flat] and being filled with a predetermined volume of air at substantially atmospheric pressure at the time of manufacture without provision for inflation to a higher pressure, and each air bag being substantially filled within its interior with a resiliently compressible open cell foam, whereby the padding effect of the air bag in use of the saddle is provided by the combination effects of the air sealed within the bag and the foam filling.

9. The saddle of claim [8] *7* comprising a flexible lining layer between the bags and packing, the lining layer serving to inhibit puncturing of the air bags during insertion of the packing into the panel.

* * * * *